US007021949B1

(12) United States Patent
Boers

(10) Patent No.: US 7,021,949 B1
(45) Date of Patent: Apr. 4, 2006

(54) ELECTRICAL PLUG AND GRIP COMBINATION

(76) Inventor: Rosemary K. Boers, 355 S. Huachuca Blvd., Unit 20, Huachuca City, AZ (US) 85616

( * ) Notice: Subject to any disclaimer, the term of this patent is extended or adjusted under 35 U.S.C. 154(b) by 0 days.

(21) Appl. No.: 11/182,183

(22) Filed: Jul. 15, 2005

(51) Int. Cl.
*H01R 13/62* (2006.01)

(52) U.S. Cl. ..... 439/160; 439/651; 439/923

(58) Field of Classification Search ..... 439/160, 439/923, 651, 484; D13/138.1, 138.2
See application file for complete search history.

(56) References Cited

U.S. PATENT DOCUMENTS

| | | | | | |
|---|---|---|---|---|---|
| D117,216 | S | * | 10/1939 | Clark, Jr. | D13/138.1 |
| 2,438,143 | A | | 3/1948 | Brown | |
| 2,476,735 | A | | 7/1949 | Johnson | |
| 3,160,947 | A | | 12/1964 | Sanderlin | |
| 3,602,659 | A | | 8/1971 | Egee et al. | |
| 4,850,886 | A | | 7/1989 | Berke | |
| 5,030,119 | A | * | 7/1991 | Lowe | 439/141 |
| 5,409,397 | A | * | 4/1995 | Karman | 439/484 |
| 5,516,305 | A | | 5/1996 | Haluska | |
| 5,626,495 | A | * | 5/1997 | Drewnicki | 439/651 |
| D404,984 | S | | 2/1999 | Skinner | |
| 6,111,772 | A | * | 8/2000 | Lee et al. | 363/146 |

* cited by examiner

*Primary Examiner*—Tho D. Ta

(57) ABSTRACT

An electrical plug and grip combination includes a housing that has a back side, a front side, a top side, a bottom side and a pair of lateral sides. The front side has a female plug extending therein. A male plug extends outwardly from the back side. An electrical plug may be removably extended into the female plug and electrically coupled to the male plug. A panel is attached to the front side of the housing. The panel has an upper edge, a lower edge, a forward side, a rear side, a first side edge and a second side edge. The forward side faces away from the housing and has an opening extending therein that exposes the female plug. The upper edge extends upwardly above a plane of the top side of the housing. The lower edge extends downwardly below a plane of the bottom side of side housing.

7 Claims, 2 Drawing Sheets

ELECTRICAL PLUG AND GRIP COMBINATION

BACKGROUND OF THE INVENTION

1. Field of the Invention

The present invention relates to electrical plug devices and more particularly pertains to a new electrical plug device for electrically coupling a power plug into a power outlet in such a way as to allow easy disconnection of the power plug from the power outlet.

2. Description of the Prior Art

The use of electrical plug devices is known in the prior art. U.S. Pat. No. 3,602,659 describes an electrical wall plug assembly particularly adapted for use by handicapped persons. Another type of electrical plug device is U.S. Pat. No. 4,850,886 having an actuator integral with a power plug for aiding a person in the decoupling of the power plug from a wall outlet. Still yet another such device is found in U.S. Pat. No. 5,516,305 which includes a panel having apertures extending therethrough for receiving the prongs of a power cord. The panel is positioned between a wall outlet and the power cord and the prongs extended through the apertures and into the wall outlet. A person grips the panel and urges it away from the wall outlet to remove the prongs from the outlet.

While these devices fulfill their respective, particular objectives and requirements, the need remains for a device that allows for easy disconnecting of a power plug from an outlet. The device should include finger-gripping portions and increase the overall size of a conventional male plug electrically coupled to a power plug.

SUMMARY OF THE INVENTION

The present invention meets the needs presented above by generally comprising a housing that has a back side, a front side, a top side, a bottom side and a pair of lateral sides. The front side has a female plug extending therein. A male plug extends outwardly from the back side. An electrical plug may be removably extended into the female plug and electrically coupled to the male plug. A panel is attached to the front side of the housing. The panel has an upper edge, a lower edge, a forward side, a rear side, a first side edge and a second side edge. The forward side faces away from the housing and has an opening extending therein that exposes the female plug. The upper edge extends upwardly above a plane of the top side of the housing. The lower edge extends downwardly below a plane of the bottom side of side housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
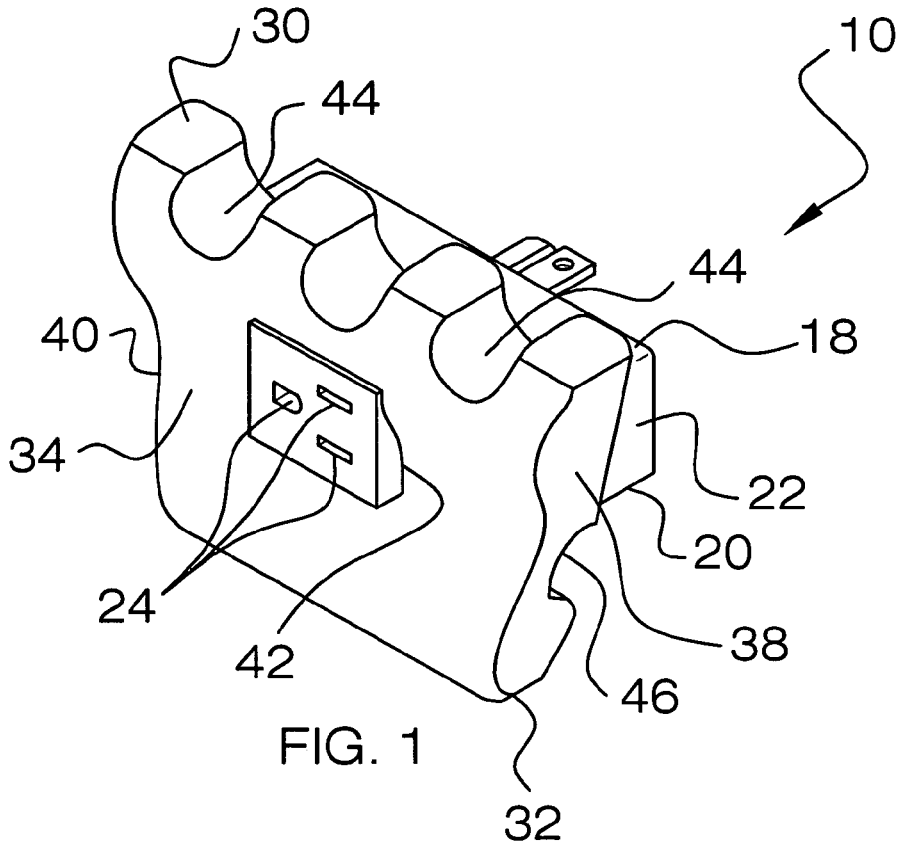
FIG. 1 is a front perspective view of an electrical plug and grip combination according to the present invention.
Figure 2:
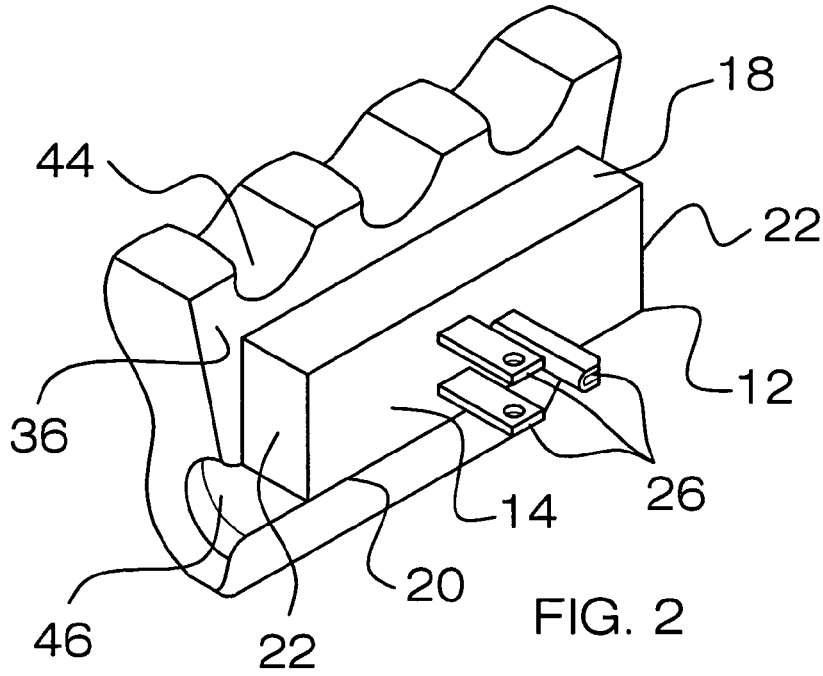
FIG. 2 is a rear perspective view of the present invention.
Figure 4:
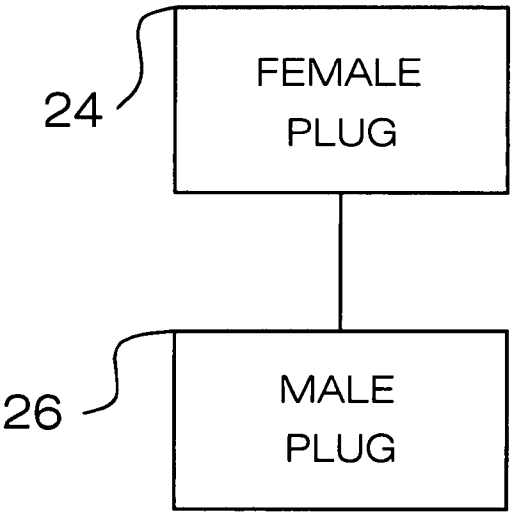
FIG. 4 is a electrical schematic view of the present invention.
Figure 3:
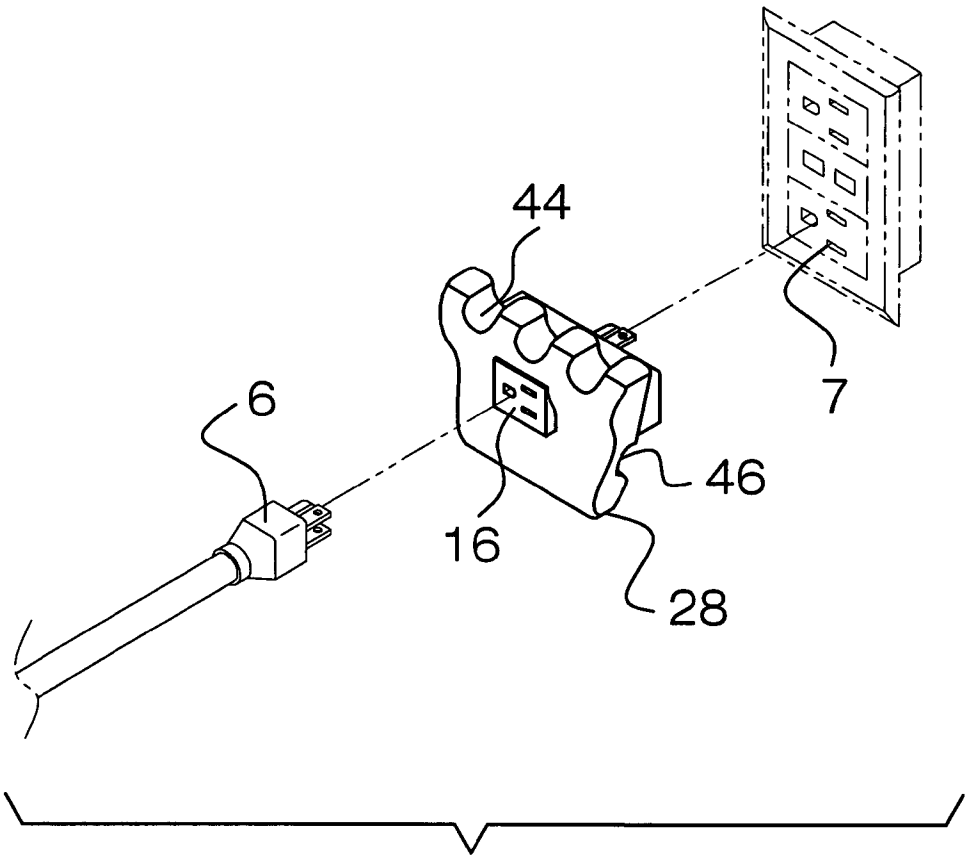
FIG. 3 is a front perspective view of the present invention.

With reference now to the drawings, and in particular to FIGS. 1 through 4 thereof, a new electrical plug device embodying the principles and concepts of the present invention and generally designated by the reference numeral 10 will be described.

As best illustrated in FIGS. 1 through 4, the electrical plug and grip combination 10 generally comprises a housing 12 that has a back side 14, a front side 16, a top side 18, a bottom side 20 and a pair of lateral sides 22. The front side 16 has a conventional female plug 24 extending therein. A conventional male plug 26 extends outwardly from the back side. The male 26 and female 24 plugs are electrically coupled together so that an electrical plug 6 may be removably extended into the female plug 24 and thereby electrically coupled to the male plug 26. The male plug 26 may then be inserted into a female power outlet 7.

A panel 28 is attached to the front side 16 of the housing 12. The panel 28 has an upper edge 30, a lower edge 32, a forward side 34, a rear side 36, a first side edge 38 and a second side edge 40. The forward side 34 faces away from the housing 12. The forward side 34 has an opening 42 extending therein that exposes the female plug 24. The upper edge 30 extends upwardly above a plane of the top side 18 of the housing 12. The lower edge 32 extends downwardly below a plane of the bottom side 20 of side housing 12. The upper edge 30 has a plurality of arcuate notches 44 therein. The notches 44 extend through the forward 34 and rear 36 sides. The plurality of notches 44 includes three notches and each defines a finger grip. The rear side 36 has a slot 46 therein that is positioned between the plane of the bottom side 20 and the lower edge 32. The slot 46 extends between the first 38 and second 40 side edges.

In use, a power cord 6 is plugged into the female outlet 24 and the male outlet 26 then plugged into a power outlet 7. The male 26 and female 24 outlets simply allow electricity to pass through the panel 28 in an uninterrupted fashion. When a person wants to unplug the power cord 6 from the power outlet 7, they may grip the panel 28 and pull it away from the power outlet 7. The panel 28 provides greater grip for a person who usually experiences difficulty when removing a cord from a power outlet while also providing additional room for their fingers.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An electrical plug coupler and grip assembly comprising:

a housing having a back side, a front side, a top side, a bottom side and a pair of lateral sides, said front side having a female plug extending therein, a male plug extending outwardly from said back side, wherein an electrical plug may be removably extended into said female plug and electrically coupled to said male plug; and a panel being attached to said front side of said housing, said panel having an upper edge, a lower edge, a forward side, a rear side, a first side edge and a second side edge, said forward side facing away from said housing, said forward side having an opening extending therein and exposing said female plug, said upper edge extending upwardly above a plane of said top side of said housing, said lower edge extending downwardly below a plane of said bottom side of said housing, said upper edge having a plurality of arcuate notches therein.

2. The assembly according to claim 1, wherein each of said notches extends through said forward and rear sides.

3. The assembly according to claim 1, wherein said rear side has a slot therein, said slot being positioned between said plane of said bottom side and said lower edge.

4. The assembly according to claim 3, wherein said slot extends between said first and second side edges.

5. An electrical plug coupler and grip assembly comprising:

a housing having a back side, a front side, a top side, a bottom side and a pair of lateral sides, said front side having a female plug extending therein, a male plug extending outwardly from said back side, wherein an electrical plug may be removably extended into said female plug and electrically coupled to said male plug; and a panel being attached to said front side of said housing, said panel having an upper edge, a lower edge, a forward side, a rear side, a first side edge and a second side edge, said forward side facing away from said housing, said forward side having an opening extending therein and exposing said female plug, said upper edge extending upwardly above a plane of said top side of said housing, said lower edge extending downwardly below a plane of said bottom side of said housing, said upper edge having a plurality of arcuate notches therein, each of said notches extending through said forward and rear sides, said plurality of notches including three notches each defining a finger grip, said rear side having a slot therein, said slot being positioned between said plane of said bottom side and said lower edge, said slot extending between said first and second side edges.

6. An electrical plug coupler and grip assembly comprising:

a housing having a back side, a front side, a top side, a bottom side and a pair of lateral sides, said front side having a female plug extending therein, a male plug extending outwardly from said back side, wherein electrical plug may be removably extended into said female plug and electrically coupled to said male plug; and a panel being attached to said front side of said housing, said panel having an upper edge, a lower edge, a forward side, a rear side, a first side edge and a second side edge, said forward side facing away from said housing, said forward side having an opening extending therein and exposing said female plug, said upper edge extending upwardly above a plane of said top side of said housing, said lower edge extending downwardly below a plane of said bottom side of said housing, said rear side having a slot therein, said slot being, positioned between said plane of said bottom side and said lower edge.

7. The assembly according to claim 6, wherein said slot extends between said first and second side edges.

* * * * *